United States Patent [19]

Farris

[11] Patent Number: 4,841,725

[45] Date of Patent: Jun. 27, 1989

[54] FUEL SPRAY DEVICE FOR GAS TURBINE AUGMENTOR OR AFTERBURNER

[75] Inventor: John R. Farris, Southfield, Mich.

[73] Assignee: Ex-Cell-O Corporation, Troy, Mich.

[21] Appl. No.: 528,719

[22] Filed: Sep. 2, 1983

[51] Int. Cl.[4] ..... F02K 3/10

[52] U.S. Cl. ..... 60/261; 60/741; 239/533.12

[58] Field of Search ..... 60/261, 734, 739, 740, 60/741; 239/453, 533.12, 533.13

[56] References Cited

U.S. PATENT DOCUMENTS

| | | | |
|---|---|---|---|
| 2,017,028 | 10/1935 | Heinrich et al. | 239/453 |
| 2,755,133 | 7/1956 | Conrad | 239/533.13 |
| 3,044,264 | 7/1962 | Seaward et al. | 60/740 |
| 3,217,780 | 11/1965 | Cremer et al. | 239/453 |
| 3,698,186 | 10/1972 | Beane et al. | 60/261 |
| 3,871,063 | 3/1975 | Halvorsen | 60/261 |

*Primary Examiner*—Carlton R. Croyle
*Assistant Examiner*—T. S. Thorpe
*Attorney, Agent, or Firm*—Edward J. Timmer

[57] ABSTRACT

The fuel spray device is adapted for use in the thrust augmentor or afterburner of a gas turbine engine. The fuel spray device includes a fuel spray manifold having a plurality of spaced apart ejection orifices and a plurality of nozzle pintles each having a decreasing cross-sectional portion, such as a conical portion, against which the orifice wall seats when there is no fuel pressure and relative to which the orifice wall moves as fuel pressure increases to increase fuel flow rate and each pintle having a substantially constant cross-sectional portion, such as a cylindrical portion, downstream of the conical portion to accommodate movement of the orifice wall of the manifold with a minimal effect on fuel flow rate through the orifice.

3 Claims, 1 Drawing Sheet

FUEL SPRAY DEVICE FOR GAS TURBINE AUGMENTOR OR AFTERBURNER

FIELD OF THE INVENTION

The invention relates to a fuel spray device of the type used in the afterburners and thrust augmentors of gas turbine engines, especially those of the spring biased pressure responsive variable area type.

BACKGROUND OF THE INVENTION

Typically, afterburners and thrust augmentors in turbojet or turbofan engines have one or more fuel spray devices which comprise a fuel spray manifold of elliptical cross-section extending circumferentially therein and a series of fuel pintles spaced around the manifold circumference. Each pintle includes a threaded attachment end received in a threaded aperture in the manifold and a conical metering tip operatively associated with an ejection orifice in the manifold. Upon application of fuel pressure inside the manifold, the elliptical manifold will distend to a more circular cross-section, causing the ejection orifice wall to move axially away from the conical pintle seat to allow fuel to discharge in controlled manner. Such fuel spray devices are shown in U.S. Pat. No. 3,871,063 issued Mar. 18, 1975 to Robert M. Halvorsen.

It has been the practice to insulate the fuel spray manifold of such devices by placing a similarly shaped heat shield at least partially therearound to provide a dead air space therebetween. For example, such a shielding technique has been used in the thrust augmentor of the F-100 gas turbine engine manufactured by Pratt & Whitney Aircraft to provide protection against the hot gases flowing from the turbine section.

Recently it has been proposed to use such fuel spray devices without heat shielding. However, as a result of the considerable heating of the fuel in the manifold by the hot turbine gases, prior art workers have expressed concern about fuel vaporization problems inside the manifold and possible shut-off of fuel flow as a result. Prior art workers have called for a higher than normal fuel pressure in the fuel spray manifold to suppress anticipated fuel vaporization at lower than normal fuel flow rates.

SUMMARY OF THE INVENTION

Although fuel vaporization problems may be alleviated by use of high fuel pressure with low fuel flow rates, prior art workers have not addressed other potential problems associated with use of such fuel spray devices unshielded in the afterburner or thrust augmentor of gas turbine engines.

The present invention has as an object to provide a fuel spray device of the type having a fuel spray manifold and nozzle pintles disposed in ejection orifices in the manifold with means for facilitating use unshielded in the engine by accommodating thermal distention or expansion of the manifold resulting from direct exposure to the hot turbine gases.

The present invention has as another object to provide such a fuel spray device with means which will allow accommodation of such manifold thermal distention without substantially altering fuel flow rate through the metering orifices.

The present invention has as still another object to provide such a fuel spray device with means for reducing or eliminating cracking of the manifold around the ejection orifices resulting from stresses required to seat the orifice wall against the nozzle pintle and required to resist the higher fuel pressures and high thermal distention effects involved.

In a typical working embodiment of the invention, the fuel spray device includes a fuel spray manifold having a plurality of ejection orifices spaced apart therearound and further includes a plurality of nozzle pintles each having a decreasing cross-sectional area portion against which the ejection orifice wall seats with no fuel pressure in the manifold and relative to which the orifice wall moves axially as fuel pressure increases to increase fuel flow rate through each orifice and each having a substantially constant cross-sectional portion downstream of the decreasing cross-sectional portion and relative to which the orifice wall can move axially to accommodate manifold distention from thermal growth effects with minimal effect on fuel flow rate through the orifices.

In one particularly preferred embodiment of the invention, the constant cross-sectional portion of the pintle is located between first and second decreasing cross-sectional area portions.

In another particularly preferred embodiment of the invention, the decreasing cross-sectional area portion of the nozzle pintle is a conical-shaped portion decreasing in diameter from the upstream to the downstream end thereof and the constant cross-sectional portion is a cylindrical-shaped portion of constant diameter along its length.

DESCRIPTION OF PREFERRED EMBODIMENTS

Figure 1:
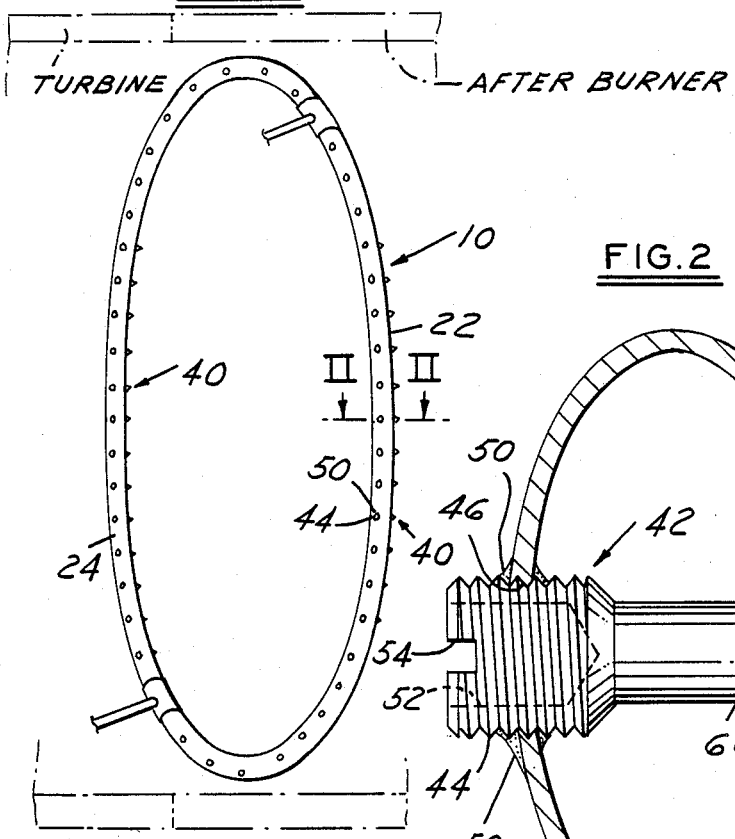
FIG. 1 is a perspective view of a ring type fuel spray manifold with nozzle pintles in a gas turbine engine shown in simplified form.

A fuel spray device of the invention is generally shown in FIG. 1 as including a ring-shaped fuel spray manifold 10 having a pair of diametrically opposed fuel supply connections 12 and 14 and including a plurality of fuel nozzles 20 spaced circumferentially therearound. A number of these fuel spray devices may be mounted in the supplemental thrust section, such as the afterburner or augmentor section, of a gas turbine engine downstream of the turbine section as is well known. In some cases, the manifolds extend radially into the afterburner or augmentor and the invention is equally applicable to these as well as any other types of afterburner or augmentor manifolds.

Figure 2:
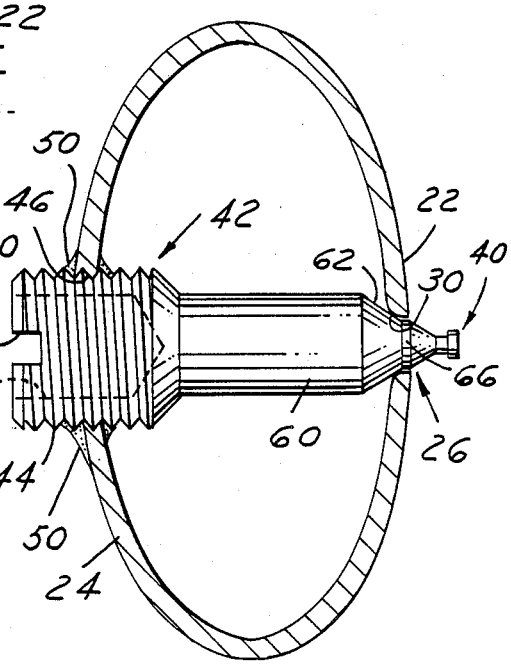
FIG. 2 is an enlarged cross-sectional view showing a nozzle constructed according to the invention.
Figure 4:
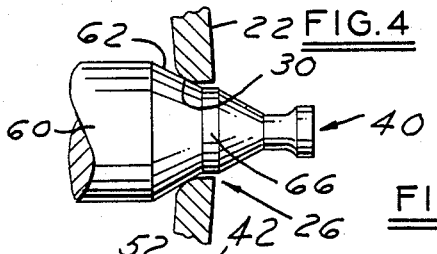
FIG. 4 is an enlarged view of the pintle.
Figure 3:
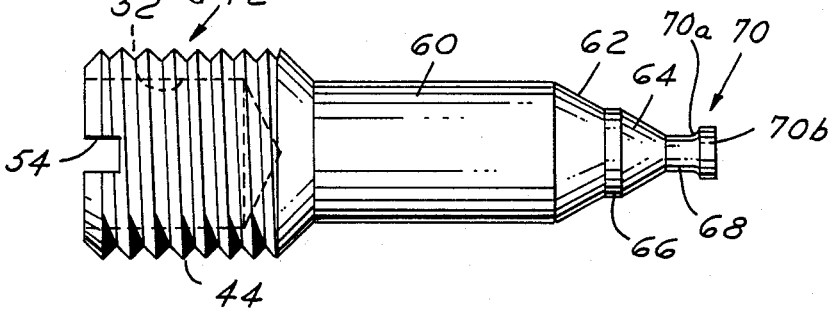
FIG. 3 is an elevation of the nozzle pintle.

The fuel spray manifold 10 is of elliptical cross-sectional shape as seen in FIG. 2 with the wider portions of the ellipse forming inner wall 22 and outer wall 24 of the manifold. The fuel nozzles 20 on the manifold 10 include a plurality of fuel ejection orifices 26 formed in the inner wall 22 such as by drilling. These orifices have a compound conical shape or profile as shown in FIG. 2 provided by wall 30 defining each orifice. The fuel nozzles 20 also include a pintle 40 having an attachment portion 42 with external threads 44 threadably received in a threaded aperture 46 in the outer wall 24 of the manifold and aligned axially with ejection orifice 26.

The attachment portion 42 is brazed to the manifold after adjustment such as at locations 50. The attachment portion 42 is of a relatively large diameter and includes counterbore 52 formed with a screwdriver slot 54 for adjustment of the pintle. A method for manufacturing such fuel spray devices is described in the Halvorsen U.S. Pat. No. 3,871,063 referred to hereinabove, the teachings of which are hereby incorporated herein by reference.

A central cylindrical portion 60 extends from the attachment portion of the pintle and terminates in a first convergent concave portion 62 (convergent toward the central axis of the pintle in the downstream direction). The first conical portion 62 is separated from a downstream second convergent conical portion 64 by an intermediate cylindrical portion 66. And, the second conical portion 64 terminates downstream in an end cylindrical portion 68 supporting a spray deflector 70 at its downstream or free end outside the manifold and spacing it in the path of the fuel discharging from the orifice 26 at the desired location. As is apparent, the spray deflector includes a divergent conical portion 70*a* and cylindrical end 70*b*.

As shown in FIG. 2, when there is no fuel pressure within the fuel spray manifold 20, the orifice wall 30 seats against the first conical portion 62. In operation, fuel pressure increases in the manifold will cause the inner wall 22 to progressively distend away from the outer wall 24, lifting the orifice wall 30 axially along the first conical portion 62. The annular opening thus created will allow the pressurized fuel to discharge from the manifold chamber and impinge upon the divergent conical portion 70*a* of the spray deflector 70, atomizing the fuel into a spray cone.

However, during operation in the unshielded condition, the manifold 20 may reach temperatures on the order of 1350° F. and thus be subject to considerable thermal growth relative to the axis of the pintle. The intermediate cylindrical portion 66 is provided downstream of the first conical portion 62 and upstream of second conical portion 64 to accommodate movement of the orifice wall 30 due to thermal growth of the manifold without substantially altering fuel flow rate during thermal growth, i.e., thermal growth results in only a minimal effect on fuel flow rate. The length, diameter and axial location of the cylindrical portion 66 are determined empirically so as to accommodate the expected axial movement of the orifice wall 30 from manifold thermal growth at operating temperature.

The second conical portion 64 may be viewed as an extension of the first conical portion and functions in the same way to control fuel flow as the orifice wall 30 distends therepast as fuel pressure is additionally increased. Of course, the degree of convergence of conical portions 62 and 64, their length and axial locations are selected to provide the desired flow rate at a given fuel pressure. And, as mentioned hereinabove, the fuel spray device of the invention is designed to provide low flow rates at higher than normal fuel pressures to minimize fuel vaporization problems in the manifold chamber. By way of illustration only, at a fuel pressure of 200 psi, the orifice flow with the invention is 22 PPH (pounds per hour) instead of 70 PPH provided on prior art fuel nozzles of this general type.

The present invention also alleviates the problem experienced with prior art fuel spray devices for low flow rate/high fuel pressure operation designed to have extra loading of the manifold against the conical seat of the pintle. The extra loading or seating stress was provided to counteract the higher fuel pressure to be experienced and the thermal growth of the manifold at operating temperature. The present invention accommodates the thermal growth of the manifold by provision of cylindrical portion 66 and accommodates the higher fuel pressure by the particular configuration of the conical portion 62 and orifice wall 30 to reduce the degree to which the manifold must be loaded or seated against the pintle for satisfactory operation. As a result, lower seating stresses are involved and cracking of the manifold around the ejection orifices has been found to be substantially eliminated.

Although the portions 62, 64 of the pintle have been described as having convergent conical-shaped portions, those skilled in the art will appreciate that other shapes of variable decreasing cross-section may be employed. Similarly, constant cross-section shapes other than cylindrical may be used for the intermediate section 65.

And, although the fuel spray device of the invention has been described by a detailed description of certain specific and preferred embodiments, it is understood that various modifications and changes can be made in them within the scope of the appended claims which are intended to include equivalents of such embodiments.

I claim:

1. In a gas turbine engine including a turbine section and a supplemental thrust section downstream thereof, a fuel spray device disposed in the supplemental thrust section without shielding from hot gases discharging from the turbine section, said fuel spray device comprising a distensible fuel manifold haing a plurality of fuel ejection orifices each defined by an orifice wall and comprising a plurality of pintles attached to the manifold with each pintle extending through a respective one of said ejection orifices and having a decreasing cross-sectional portion against which the orifice wall seats when there is no fuel pressure in said manifold and relative to which the orifice wall moves from distention of the manifold with increases in fuel pressure to increase fuel flow rate through said orifices and a substantially constant cross-sectional portion downstream of said decreasing cross-sectional portion disposed at least partially in said orifice when said orifice wall is seated against said decreasing cross-sectional portion and having a length along which the orifice wall can move with said length selected to accommodate manifold distention from thermal growth effects so that there is minimal effect on fuel flow rate through said orifices from thermal growth effects.

2. The engine of claim 1 wherein the pintle also includes a second decreasing cross-sectional portion downstream of said constant cross-sectional portion and relative to which the orifice wall moves from distention of the manifold with further increases in fuel pressure to increase fuel flow rate.

3. The engine of claim 2 wherein the decreasing cross-sectional portions of said pintle are convergent conical in shape and the constant cross-sectional portion of which is cylindrical in shape.

* * * * *